US005853105A

United States Patent [19]

Roman et al.

[11] Patent Number: 5,853,105

[45] Date of Patent: Dec. 29, 1998

[54] CONTAINER WITH STABILIZING BEADS

[75] Inventors: Linda Carol Roman, Chicago, Ill.; Daniel Brian Kurtz, Sandusky, Ohio

[73] Assignee: Kraft Foods, Inc., Northfield, Ill.

[21] Appl. No.: 948,009

[22] Filed: Oct. 9, 1997

[51] Int. Cl.[6] ..... A47J 27/00; A47J 19/00; A65D 1/34; A65D 21/032

[52] U.S. Cl. ..... 220/575; 99/426; 99/448; 99/452; 220/23.83; 220/556; D7/555

[58] Field of Search ..... 99/426, 448, 430, 99/452; 206/558, 561, 564, 565, 518; 229/406; 220/575, 556, 23.8, 23.83, 914, 735; 215/223–225, 256; 426/396, 106, 118, 130; D7/555, 553.8; D9/347

[56] References Cited

U.S. PATENT DOCUMENTS

| | | | |
|---|---|---|---|
| D. 3,016 | 5/1868 | Savournin . | |
| D. 91,084 | 11/1933 | Pittman . | |
| D. 132,100 | 4/1942 | Ipsen . | |
| D. 184,888 | 4/1959 | Pickett . | |
| D. 196,376 | 9/1963 | Hines . | |
| D. 220,313 | 3/1971 | Collie . | |
| D. 247,124 | 1/1978 | Beecher . | |
| D. 257,109 | 9/1980 | Conti . | |
| D. 280,383 | 9/1985 | Tendick et al. . | |
| D. 297,115 | 8/1988 | Fontana et al. . | |
| D. 297,116 | 8/1988 | Fontana et al. . | |
| D. 297,117 | 8/1988 | Fontana et al. . | |
| D. 297,118 | 8/1988 | Fontana et al. . | |
| D. 297,119 | 8/1988 | Fontana et al. . | |
| D. 339,522 | 9/1993 | Zoss . | |
| D. 351,997 | 11/1994 | Finnah . | |
| D. 359,494 | 6/1995 | Hedaya . | |
| 1,595,356 | 8/1926 | Moseman . | |
| 2,549,440 | 4/1951 | Erro . | |
| 2,554,086 | 5/1951 | Block . | |
| 3,051,346 | 8/1962 | Grogel . | |
| 3,464,618 | 9/1969 | Martelli et al. . | |
| 3,896,770 | 7/1975 | Timmins | 99/452 |
| 4,026,457 | 5/1977 | Schubert . | |
| 4,182,232 | 1/1980 | Tomatis | 99/452 |
| 4,375,859 | 3/1983 | Fillmore | 215/223 |
| 4,524,876 | 6/1985 | Kusz | 215/224 |
| 4,573,599 | 3/1986 | Fillmore | 215/225 |
| 4,989,742 | 2/1991 | Powell . | |
| 5,184,750 | 2/1993 | Moller | 220/575 |
| 5,236,119 | 8/1993 | Chu . | |
| 5,246,070 | 9/1993 | McSpadden | 206/561 |
| 5,328,051 | 7/1994 | Potter et al. | 220/575 |
| 5,408,804 | 4/1995 | Schröder . | |
| 5,566,852 | 10/1996 | Emery | 220/556 |
| 5,598,944 | 2/1997 | Aragona . | |
| 5,607,077 | 3/1997 | Torkelson | 220/575 |
| 5,697,512 | 12/1997 | Brickley | 220/23.8 |

*Primary Examiner*—Timothy F. Simone
*Attorney, Agent, or Firm*—Fitch, Even, Tabin & Flannery

[57] ABSTRACT

A container for food products which includes a large, smooth, continuously curved label area on a front wall, a large label area on a top cover, and a pair of stabilizing projections such as beads associated with the bottom edge of the front wall to stabilize the container in a display position in which the top wall is tilted up to an inclined upright position rather than a horizontal position, with the stabilizing projections engaging a support surface on which the container is supported. In its preferred embodiment, the container comprises a pair of compartments joined by a generally horizontal web having a flange which includes a flat stabilizing front transverse edge portion to cooperate with the stabilizing projections on the curved bottom edge of the front wall. The compartments comprise a larger front compartment and a smaller rear compartment to maintain an acceptably low center of mass for satisfactory stability when the container is in its inclined position.

11 Claims, 4 Drawing Sheets

CONTAINER WITH STABILIZING BEADS

BACKGROUND OF THE INVENTION

1. Field of the Invention

The invention relates generally to containers for food products, and more particularly to a single-serving container for dairy products such as cottage cheese, yogurt, and the like, alone or in combination with complementary products such as fruit products.

2. Background and Description of Related Art

In the past, inexpensive two-compartment containers have been used for products such as cottage cheese and fruit, wherein a large compartment is provided for containing cottage cheese, and a smaller compartment is provided for containing a fruit product to be mixed with the cottage cheese. The containers have included peelably sealed covers attached to a top wall or web connecting the two compartments.

In providing a container for commercial packaging of food products, among the considerations that must be addressed are the ability of the container to receive product in high-speed commercial filling operations; the degree of difficulty that will be encountered by the consumer in dispensing product from the container; the ability of the container to withstand various loads, such as stacking loads, during filling, sealing, shipping, display, and consumer use; the ability of the container to be packed efficiently among like containers; the cost of manufacture of the container; the costs and difficulty associated with sealing the container; and labeling. As to the last point, it is important that the container be capable of receiving labeling, which may comprise direct application of ink, paint, dye, or the like, directly to the container, or may include adhesively securing a label made of paper, plastic, or another material. It is also important that containers of this type be aesthetically pleasing where the containers are intended to be displayed for commercial sale to consumers in grocery stores and/or other retail establishments.

It is a general object of the invention to provide a lightweight, economical, commercially viable container for food products which adequately addresses the above considerations, and which provides improved display capability.

SUMMARY OF THE INVENTION

The invention provides a container for food products which includes a large, smooth, continuously curved label area on a front wall, a large label area on a top cover, and a pair of stabilizing projections such as beads associated with the bottom edge of the front wall to stabilize the container in a display position in which the top wall is tilted up to an inclined upright position rather than a horizontal position, with the stabilizing projections engaging a support surface on which the container is supported.

In its preferred embodiment, the container comprises a pair of compartments joined by a generally horizontal web having a flange which includes a flat stabilizing edge portion oriented transversely across the front thereof to cooperate with the stabilizing projections on the curved bottom edge of the front wall.

The projections are preferably generally spheroidal, and are integrally molded components of the container. Thus, the preferred container has a one-piece body in which the compartments, the connecting web, and the stabilizing projections are an integral, unitary, one-piece structure. A cover preferably is peelably sealed to the web so that each compartment may be hermetically sealed from the environment and from the other compartment, and may readily be opened conveniently for use by a consumer by lifting a corner or edge portion of the cover and peeling it away from the web.

Further objects, advantages, and features of the invention will become apparent from the following description, taken in conjunction with the accompanying drawings.

Figure 1:
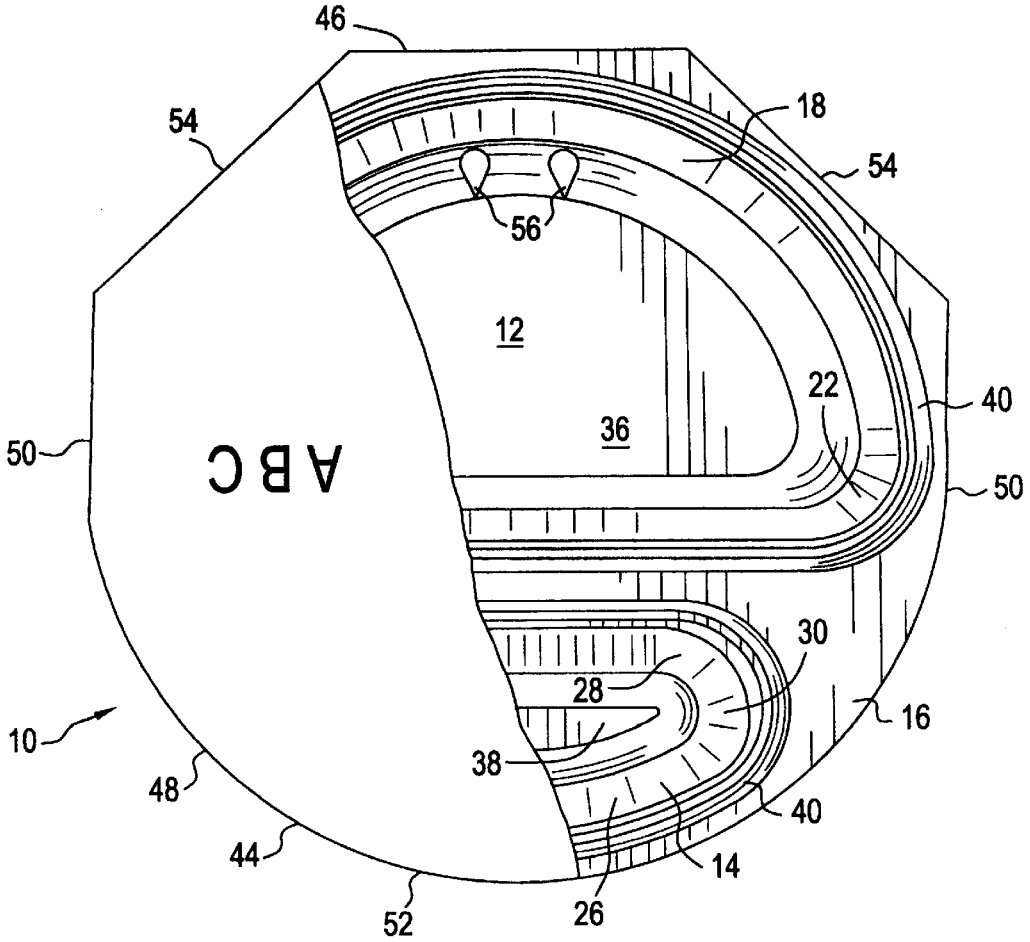
FIG. 1 is a plan view of a container in accordance with a preferred embodiment of the invention, with a removable cover for the container being partially broken away to show the interior of the container.
Figure 2:
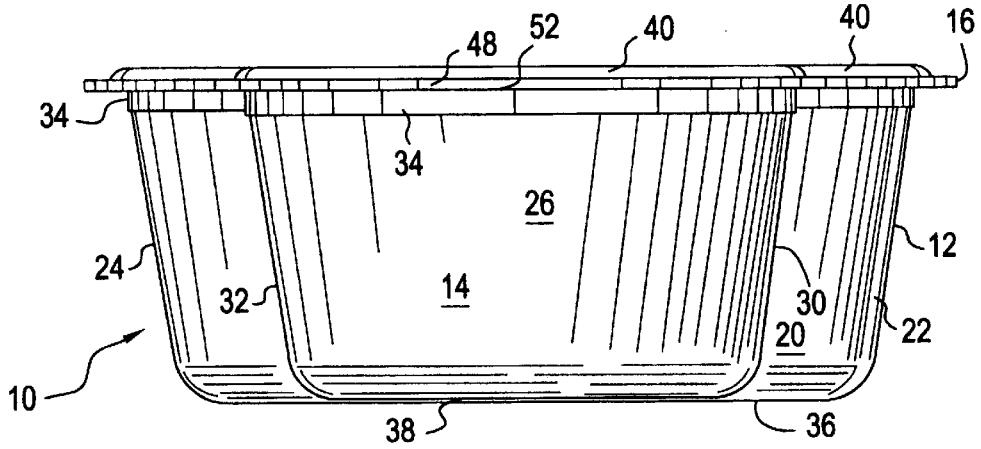
FIG. 2 is a rear elevational view of the container of FIG. 1.
Figure 3:
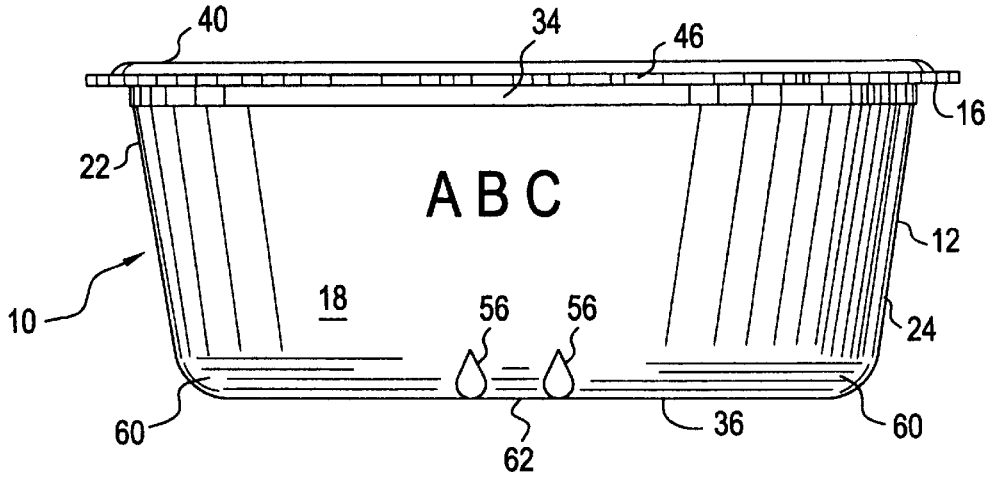
FIG. 3 is a front elevational view of the container of FIG. 1.

The container is shown without the cover in FIGS. 2, 3, 5, and 6, to illustrate surfaces hidden by the cover prior to its removal.

DETAILED DESCRIPTION OF PREFERRED EMBODIMENT

The invention is preferably embodied in a container having one or more upwardly opening compartments and a removable seal for closing the compartment or compartments prior to use. In the illustrated embodiment, described below, the container is intended for use in packaging two separate food product components, such as cottage cheese and fruit, cheese and crackers, chips and salsa, cheese and breadsticks, etc., but in other embodiments, the container may be used for other dairy products such as yogurt, sour cream, cream cheese, cheese spreads, pudding, or milk; or non-dairy food products such as applesauce, juices, etc.

The container 10 in the illustrated embodiment comprises first and second generally cup-shaped compartments 12 and 14 joined by an upper, generally horizontal web 16. Each of the compartments 12 and 14 is generally D-shaped in plan. The first compartment comprises a curved outer side wall 18 and a flat inner side wall 20 which intersect at rounded corners 22, 24. The outer side wall extends through an arc of about 180 degrees as viewed in plan, and is generally frustoconical in shape.

The second compartment 14 is smaller than the first and, like the first compartment, comprises a curved, generally frustoconical outer side wall 26 and a generally flat inner side wall 28 which intersect at rounded corners 30 and 32. The flat inner side walls 20 and 28 are adjacent and parallel to one another.

Each of the compartments has a stacking ring 34 about its periphery near its upper end. The first compartment 12 has a generally planar bottom wall 36 intersecting the side walls 18 and 20. The smaller compartment 14 similarly has a generally planar bottom wall 38 intersecting side walls 26 and 28. Each compartment tapers inward from top to bottom, having an inwardly stepped configuration near its upper end to form the stacking ring, and being inwardly tapered beneath the stacking ring. Each of the side walls has a rounded bottom edge at which it joins the bottom wall. A raised ridge 40 extends about the periphery of the upper end of each compartment in the web.

A removable top cover 42 is provided to seal the container hermetically to preserve freshness and prevent leakage. Each compartment is peelably sealed by adhesive and/or heat sealing of the top cover 42 to the ridge 40 associated with each compartment. The cover preferably is sealed to the web 16 about its periphery as well, but may be left unsealed at one or more locations along the periphery to facilitate removal. The cover 42 is substantially planar, having minor variations from planarity of up to about, e.g., 1/32 in. on its upper surface due to the raised ridges 40. The top cover has a longitudinal dimension of about 4¾ in. and a width of about 4¾ in. The height of the container is about 1¾ in.

Figure 6:
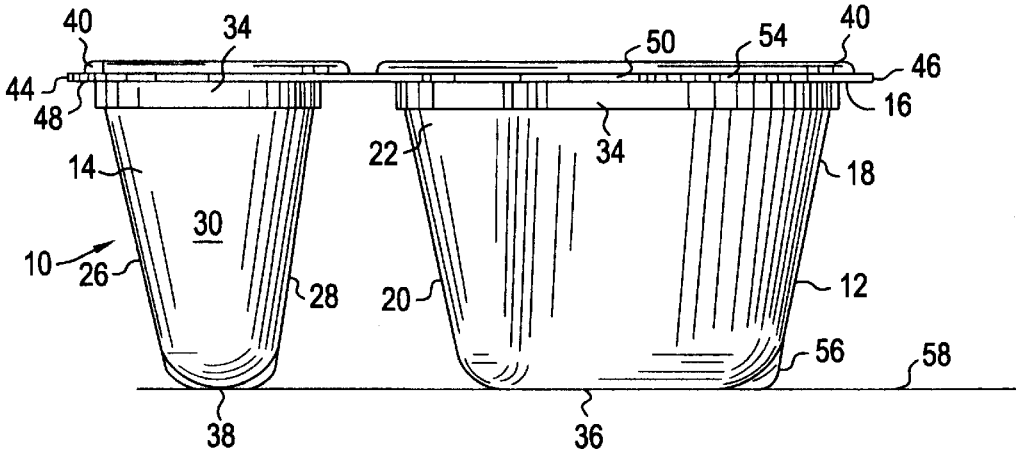
FIG. 6 is a side elevational view of the container of FIG. 1, taken from the right-hand side of FIG. 1, the left-hand side view being substantially a mirror image thereof.
Figure 7:
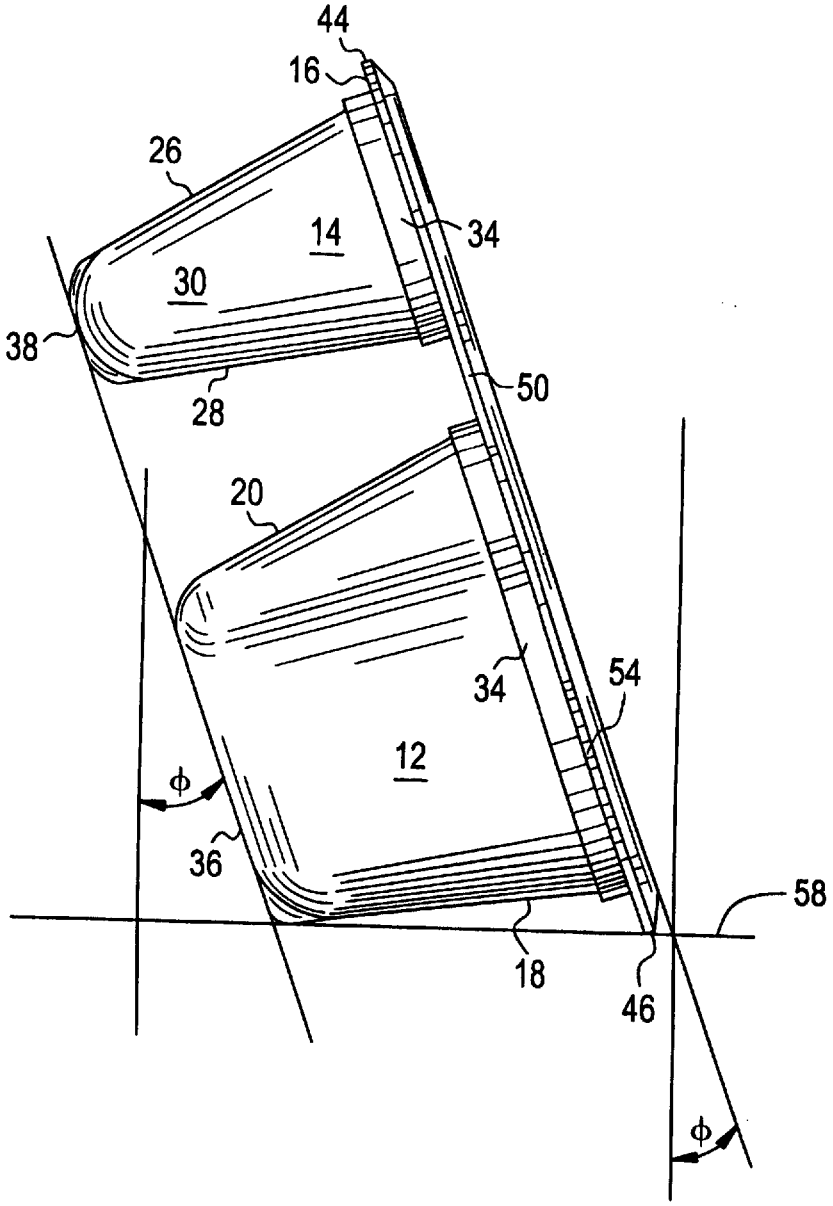
FIG. 7 is a side elevational view similar to that of FIG. 6, but showing the container in an inclined display position.

The container preferably is capable of being displayed in a first, generally horizontal position as shown in FIG. 6 in which it is stably supported on a flat supporting surface with its bottom walls resting thereon. The container is also capable of being supported in a second, inclined display position, as shown in FIG. 7, in which the container rests on a bottom edge portion of one of the compartments and on a transverse linear front edge portion 46 of the web. Indicia such as product identification information, trademarks, promotional information, color logos, and the like are preferably provided both on the removable cover and on the outer side wall surfaces of the compartments.

The periphery of the web has a generally U-shaped portion 48 comprising a pair of linear side portions 50 which blend with a semi-circular rear portion 52 of the web. The flat or linear transverse front edge portion 46 located generally centrally across the front of the container is joined by flat or linear diagonal segments 54 on each end to the U-shaped portion 48. The transverse linear front edge portion 46 functions as a stabilizing edge when the container is in its upright or inclined position on a horizontal shelf surface 58 as shown in FIG. 7.

The cover 42 has a shape substantially identical to that of the web 16, such that the periphery of the cover 42 in the illustrated embodiment coincides with that of the web. In other embodiments, a pull tab or the like may be provided on the cover, extending beyond the periphery of the web, to facilitate opening.

A container having a rounded, arcuate bottom front edge portion contacting a support surface with the container in an inclined position may be susceptible to becoming unstable or unbalanced in response to relatively minimal disturbance, as may occur on a supermarket shelf during normal examination, removal and replacement of containers by consumers.

In accordance with a feature of the preferred embodiment of the invention, the larger compartment 12 is disposed at the front of the container 10, and a pair of spaced stabilizing beads 56 are provided along the bottom edge 60 of the front portion of the outer side wall of the larger compartment 12, so that the container may be more stably supported in an inclined position with the cover 42 at an upwardly inclined angle as shown, e.g., in FIG. 7.

The beads are preferably of sufficiently small size to leave a large, smooth, continuously curved label area on the front side wall 18, uninterrupted by the stabilizing beads. The stabilizing beads 56 preferably project laterally a sufficient distance from the bottom edge of the side wall to enable both of the beads to contact the supporting surface 58 simultaneously when the container is in its inclined position, without the portion 62 of the bottom edge 60 of the side wall between the beads interfering with the stability of the container. The beads also preferably do not project below the bottom surface of the bottom wall 36 of the larger compartment 12 when the container is in its flat position as shown, e.g., in FIG. 6, with the bottom surfaces of the compartments resting on a support surface 58. Thus, the beads do not interfere with the stability of the container in its flat position, but are effective to increase stability of the container when it is in its inclined position.

In the illustrated embodiment, the beads are spheroidal in shape and are separated from each other by a center-to-center distance of about ½ in. The illustrated beads are relatively small, each having a vertical dimension of about 0.2 in. and a width or diameter of about 0.16 in. In other embodiments, the bead diameter may vary between 1/32 in. to ¼ of the diameter or transverse dimension of the front compartment 12.

In providing means to stabilize the container on the bottom front edge, it is desirable to avoid interruption of the smooth, continuously curved front label area. While wider spacing of the beads would increase stability of the container in its inclined position, the spacing of the illustrated beads is limited by their size. If the beads were spaced too widely, the bottom front edge surface between the beads would project too far, interfering with the stabilizing effect. Increasing the size of the beads to address this problem would tend to interfere with the aesthetics of the container, and would potentially interfere with labeling. The size, placement, and shape of the beads in the illustrated embodiment represent a balancing of the competing interests of increased stability on one hand, and aesthetic and labeling considerations on the other.

Figure 4:
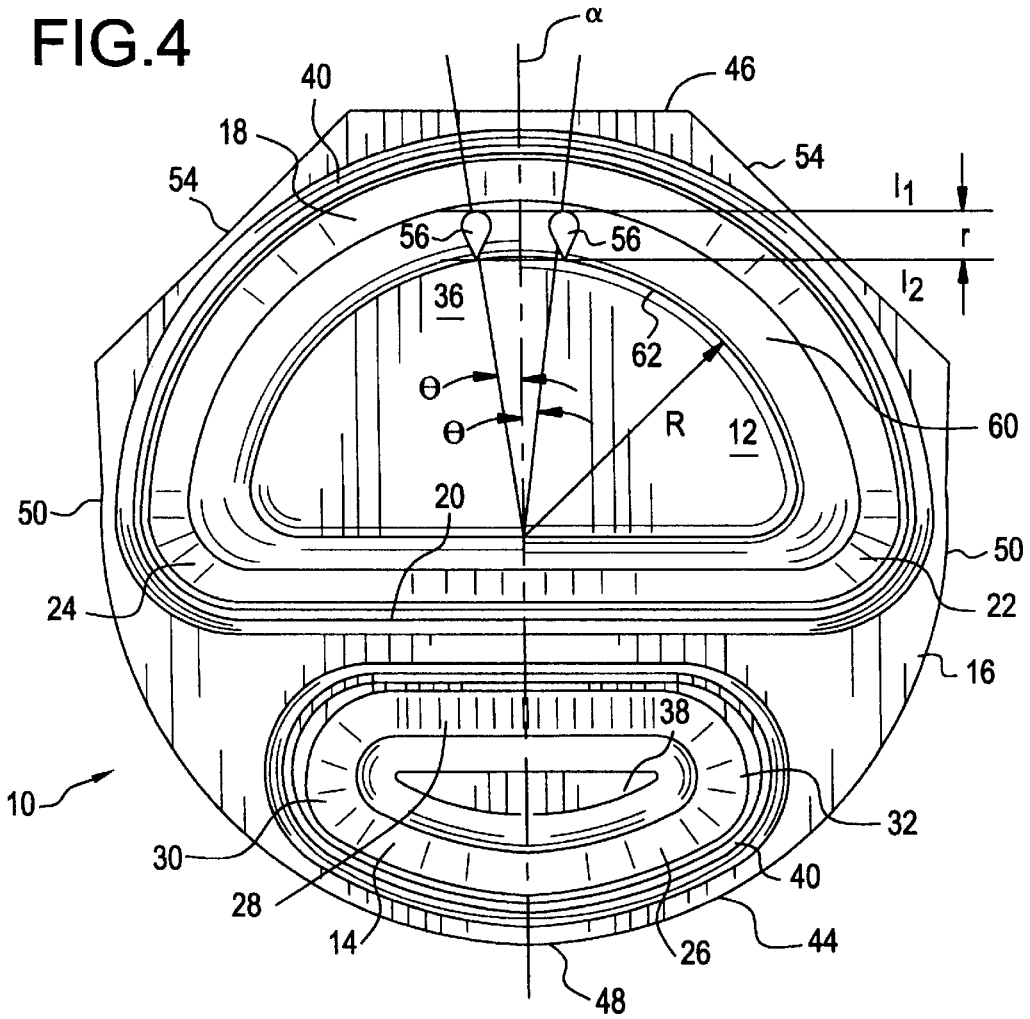
FIG. 4 is a bottom view of the container of FIG. 1.
Figure 5:
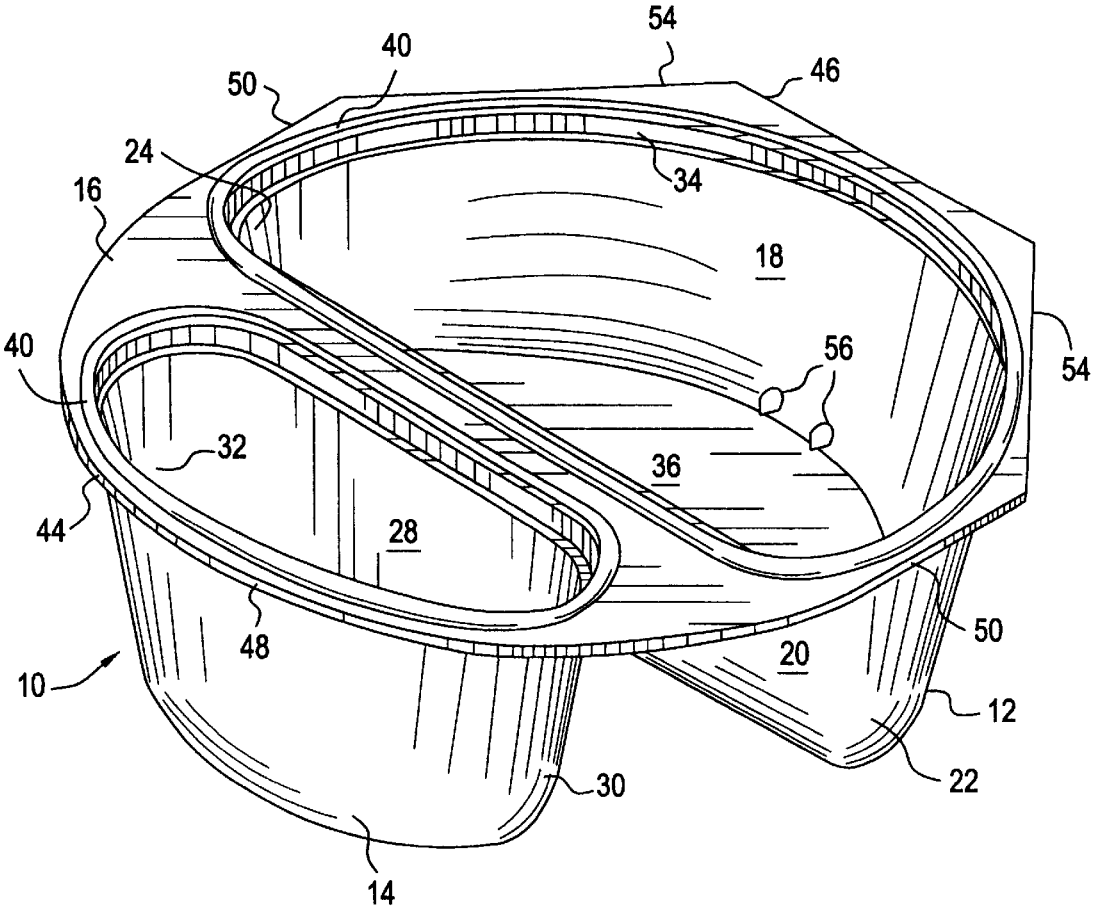
FIG. 5 is a perspective view of the container of FIG. 1.

The size and placement of the beads may be described with reference to FIG. 4, wherein $l_1$ is a line tangent to the forwardmost surfaces of the beads, $l_2$ is a line perpendicular to the longitudinal axis of the container extending through the radially inward ends of the beads, R represents the radius of the front edge 62 of the bottom wall 36, r is the radius of the beads and is also the horizontal component of the distance between $l_1$ and $l_2$, and θ is the angle between the longitudinal axis of the container and a radial line extending to the point at which either of the beads intersects $l_1$. The size and placement of the beads are preferably governed by the relationship $r \geqq R\ (1\text{-}\cos\theta)$.

The diameter or transverse dimension of the bottom wall of the larger compartment 12 is preferably between 2 in. and 6 in., and in the illustrated embodiment is about 3½ in. In the inclined position of the container, as shown in FIG. 7, the top wall and bottom wall are inclined at an angle φ to the vertical. The angle of inclination φ preferably is between 15° and 30°, and in the illustrated embodiment is about 20°. The front surface of the front compartment 12 preferably has a generally frustoconical, smooth, continuously curved, uninterrupted label area having a vertical dimension of about 1⅛ in., extending through an area of about 180°.

The container preferably is made of a plastic material having a wall thickness of less than 0.05 in., preferably about 0.02 to 0.025 in., and is preferably manufactured by thermoforming the compartments and web as a unitary, one-piece item, with the cover being made of a metal foil, plastic, paperboard, or the like, or a combination of two or more materials. Formation of the beads may be facilitated by forming bead cavities of the desired generally spheroidal shape in the mold cavity using a ball end mill of suitable diameter, e.g., 0.16 in. diameter.

From the foregoing, it should be appreciated that the invention provides a novel and improved container. The invention is not limited to the embodiment described above and shown in the illustrated drawings, nor is the invention limited to any particular embodiment. The invention is more particularly described and pointed out in the following claims.

What is claimed is:

1. A food product container comprising at least one compartment comprising a bottom wall, at least one curved side wall extending upward therefrom, a flange extending outward about the upper end of said at least one side wall, and a removable top cover having display indicia thereon, said flange having a flat stabilizing edge portion thereon, said container being capable of being stably supported on a flat supporting surface in a first, generally horizontal position with said bottom wall resting generally horizontally on the flat supporting surface, said container further being capable of being stably supported in a second, inclined display position with said stabilizing edge portion and a bottom edge portion of said side wall resting on the flat supporting surface;

said container further comprising a pair of stabilizing beads spaced from one another along the bottom edge of said side wall, each said bead having sufficiently small size to leave a large, smooth, continuously curved label area on said side wall uninterrupted by said stabilizing beads, said stabilizing beads projecting laterally a sufficient distance from said bottom edge of said side wall to enable both of said beads to contact the supporting surface simultaneously when said container is in its inclined position, without said bottom edge of said side wall between the beads interfering with the stability of the container.

2. The container of claim 1 wherein said bottom wall has a substantially arcuate front edge, each of said beads being angularly displaced from the longitudinal axis of the container by an angle "θ" on said substantially arcuate front edge, the front edge having a substantially uniform radius of curvature "R" adjacent said beads, each bead protruding axially a distance "r" from said substantially arcuate front edge, and wherein $r \geqq R\ (1\text{-}\cos\theta)$.

3. The container of claim 2 wherein said container includes first and second compartments, the first compartment being larger than the second and disposed forwardly thereof.

4. The container of claim 3 wherein said top cover has a display area thereon larger than the display area of said at least one curved side wall.

5. The container of claim 4 wherein said continuously curved label area has a vertical dimension of at least about 1 in.

6. The container of claim 1 wherein each of said beads is generally spheroidal.

7. The container of claim 1 wherein each of said beads is formed integrally with said side wall and said bottom wall so that said beads are components of a one-piece, unitary structure with said bottom wall and said side wall.

8. The container of claim 2 wherein θ is between 10° and 30°.

9. The container of claim 8 wherein θ is about 20°.

10. The container of claim 1 wherein said top cover and said bottom wall are inclined at an angle ϕ between 15° and 30° to the vertical when said container is in said inclined position.

11. The container of claim 1 wherein said top cover and said bottom wall are inclined at an angle ϕ of about 20° to the vertical when said container is in said inclined position.

* * * * *